US007063124B2

(12) United States Patent
Walker et al.

(10) Patent No.: US 7,063,124 B2
(45) Date of Patent: Jun. 20, 2006

(54) SYSTEM FOR SECURING A SHADE FABRIC TO A ROLLER TUBE

(75) Inventors: Mark A. Walker, Whitehall, PA (US); Michael S. Kokolus, Northampton, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/770,812

(22) Filed: Feb. 2, 2004

(65) Prior Publication Data

US 2005/0167058 A1 Aug. 4, 2005

(51) Int. Cl.
*A47H 13/00* (2006.01)

(52) U.S. Cl. ..... 160/392; 160/395

(58) Field of Classification Search ..... 160/383, 160/391, 392, 394, 395, 397, 398, 403, 404
See application file for complete search history.

(56) References Cited

U.S. PATENT DOCUMENTS 735,540 A * 8/1903 Lyon ..... 160/398
783,759 A * 2/1905 Record ..... 160/392
806,427 A * 12/1905 Record ..... 160/263
996,333 A * 6/1911 Hartshorn ..... 160/404
1,013,531 A * 1/1912 Carmany ..... 160/297
1,202,287 A * 10/1916 Hartshorn ..... 160/392
3,329,195 A * 7/1967 Kochanowski ..... 160/24
3,724,524 A * 4/1973 Potter ..... 160/24
5,002,111 A * 3/1991 Boiteau ..... 160/67

* cited by examiner

*Primary Examiner*—David Purol
(74) *Attorney, Agent, or Firm*—Drinker Biddle & Reath LLP

(57) ABSTRACT

An insert having a peripheral contact surface is received by a roller tube channel to engage a shade fabric. The insert is adjustable to compress the shade fabric within the channel. The insert may include a body having opposite side edges and at least one elongated slot. The insert member may include pivotable prongs or deflectable slot walls adjacent the slots. Pivoting of the prongs or deflection of the slot walls urges the body toward a channel side wall to compress the shade fabric. The insert may, alternatively, include a body having diametrically opposite portions respectively defining a curved outer periphery and a planar outer periphery, the body being wider between the curved portions. The insert is pivotable about an axis to grip the shade fabric between a channel side wall and one of the curved portions of the body.

20 Claims, 7 Drawing Sheets

SYSTEM FOR SECURING A SHADE FABRIC TO A ROLLER TUBE

FIELD OF THE INVENTION

The present invention relates to roller shades having a flexible shade fabric windingly received on a roller shade tube. More particularly, the present invention relates to a system for securing the shade fabric to the roller shade tube.

BACKGROUND OF THE INVENTION

Roller shades include a flexible shade fabric wound onto a roller tube. The roller tube is rotatably supported so the shade can be raised and lowered by rotating the roller tube.

Shade fabrics are secured to roller tubes in a variety of ways. It is known to secure a shade fabric to a roller tube by stapling an end of the shade fabric to the tube. It is also known to secure a shade fabric to a roller tube by gluing or taping the end of the shade fabric to the tube.

It is also known to secure a shade fabric to a roller tube using a spline that is attached to the shade fabric, such as by welding the spline to the fabric. The attached spline is then inserted, endwise, into a retainer slot defined by the roller tube. It is also known to use elastic splines forced into a retainer slot over a shade fabric to secure the shade fabric to the roller tube.

Engagement of a shade fabric to a roller tube by conventional techniques does not facilitate adjustment of the shade fabric. This is particularly true with respect to gluing and stapling because relative movement between the shade fabric and roller tube is limited upon engagement of the glue or staple. Gluing and stapling of a shade fabric may also result in undesirable marring of the shade fabric.

SUMMARY OF THE INVENTION

According to the present invention, there is provided a system for securing a flexible shade fabric to a rotatably supported roller tube for winding receipt of the flexible shade fabric onto the tube. The shade fabric securing system includes an insert member having a peripheral contact surface. A channel defined by the roller tube includes opposite first and second side walls and is dimensioned for receipt of an end portion of a shade fabric. The insert member is received in the channel to engage the end portion of the shade fabric between the insert member and the roller tube. The insert member is adjustable to adjustably compress the end portion of the shade fabric between the peripheral contact surface of the insert member and one of the side walls of the channel to secure the shade fabric to the roller tube.

According to one embodiment of the invention, the insert member includes a body having opposite first and second side edges and at least one elongated prong connected to the body adjacent the first side edge of the body. The second side edge of the body and the second side wall of the channel cooperate to engage the end portion of the shade fabric therebetween. The prong is pivotable with respect to the body such that contact between the prong when pivoted and the first side wall of the channel urges the body of the insert member toward the second side wall of the channel to compressively secure the end portion of the shade fabric to the roller tube between the second side edge of the body and the second side wall of the channel. Preferably, the body of the insert member and the prong are made from aluminum. Preferably, the prong is located within a recess in the first side edge of the body and defines a tool-receiving slot with the body of the insert member for receipt of a tool for pivoting the prong by applying torque to the tool.

According to another embodiment of the invention, the insert member includes a body having opposite first and second side edges and at least one elongated slot formed in the body. The at least one slot is located inwardly from the first side edge of the body to define a slot wall adjacent the first side edge having opposite ends connected to the body. The slot wall being outwardly deflectable with respect to the first side edge such that contact between the slot wall and the first side wall of the channel urges the body of the insert member toward the second side wall of the channel.

According another embodiment of the invention, the insert member includes a body having diametrically opposite portions defining a curved outer periphery and orthogonally located diametrically opposite portions defining a substantially planar outer periphery. The body is wider between the curved outer periphery than between the substantially planar outer periphery. The insert member is pivotable about an axis to grip the end portion of the shade fabric between the second side wall of the channel and one of the curved portions. Preferably, the insert member includes a tool-receiving head on the base having intersecting slotted recesses for receiving a tool.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings.

DETAILED DESCRIPTION OF THE DRAWINGS

Figure 1:
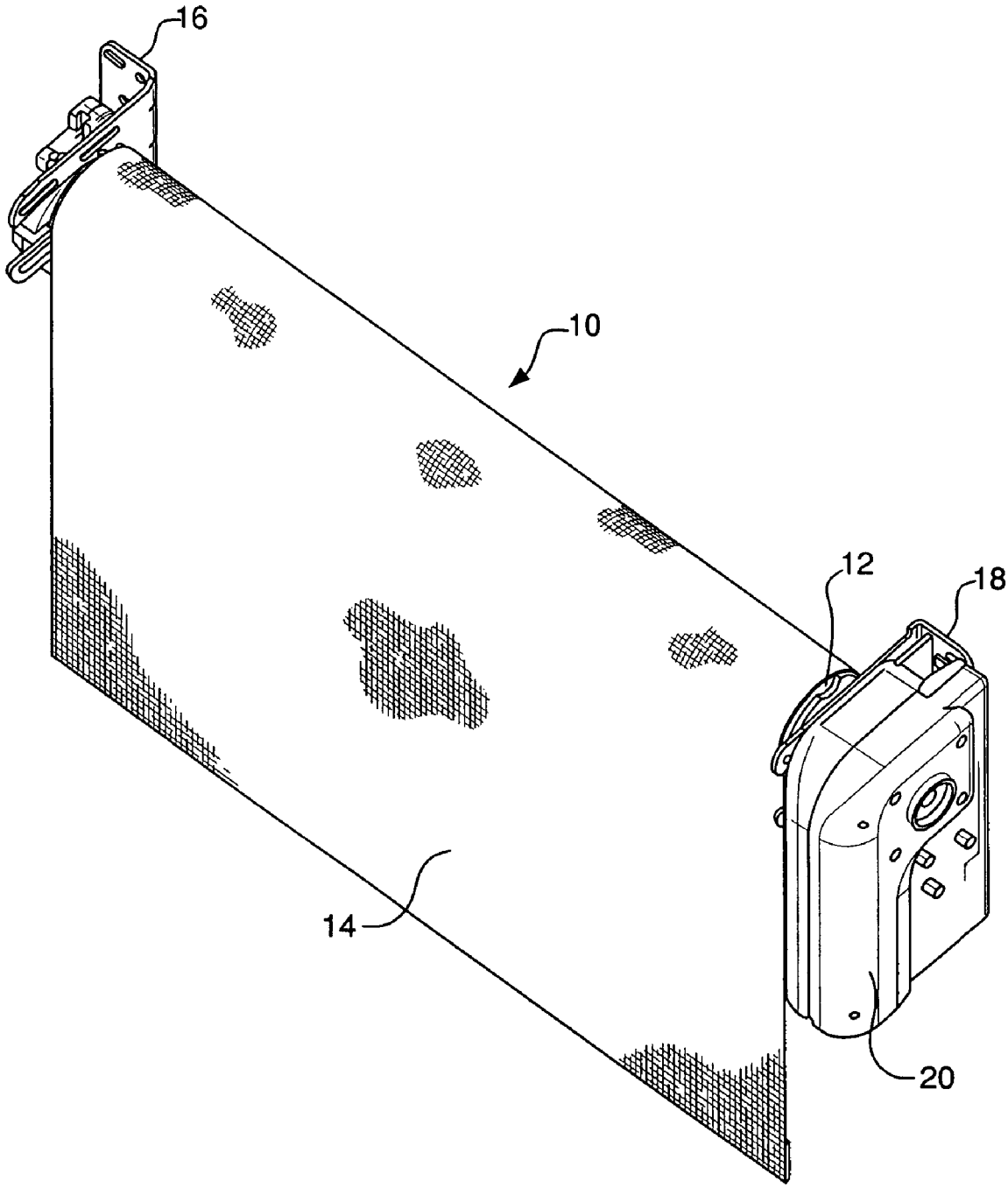
FIG. 1 is a perspective view of a roller shade incorporating a shade fabric securing system according to the present invention.
Figure 2:
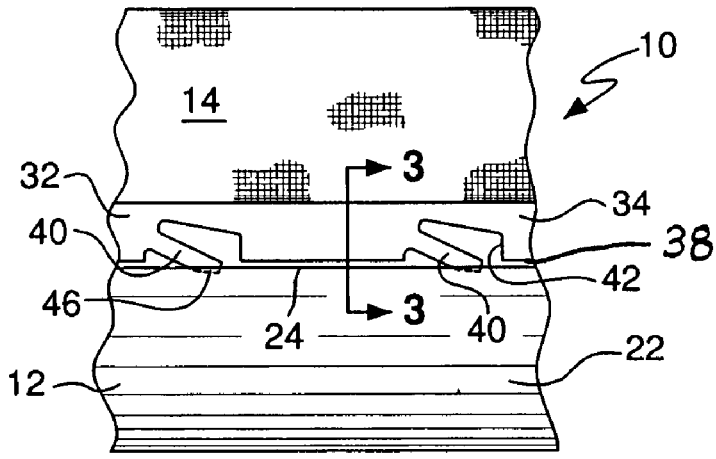
FIG. 2 is a partial elevation view of the roller shade of FIG. 1 in an unwound condition to illustrate the shade fabric securing system.
Figure 3:
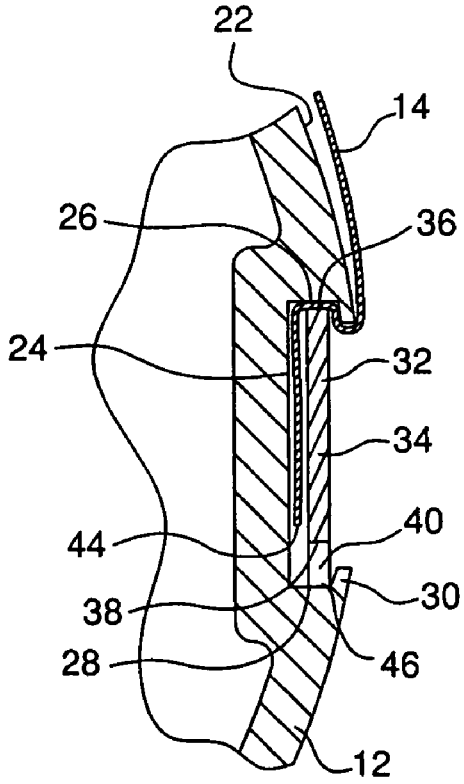
FIG. 3 is a sectional view taken along line 3—3 in FIG. 2.

Referring to the drawings, where like numerals identify like elements, there is illustrated in FIGS. 1–3 a system for securing a shade fabric 14 to a roller tube 12 of a roller shade 10. As will be described in greater detail, the present invention provides for engagement between a shade fabric and a roller tube without damaging the shade fabric and further provides for adjustment of the relative position of the shade fabric with respect to the roller tube, thereby facilitating installation.

The shade fabric 14 is flexible to provide for winding receipt of the shade fabric 14 by the roller tube 12. The roller tube 12 is elongated, substantially cylindrical, and rotatably supported by brackets 16, 18. The brackets 16, 18 are adapted to be secured to a fixed surface, such as a wall for example, by fasteners (not shown). The roller shade 10 shown in FIG. 1 is a motorized shade and includes a drive unit 20, which engages the roller tube 12 to drivingly rotate the roller tube 12 to raise and lower the shade fabric 14. The shade engagement system of the present invention, however, is not limited to motorized roller shades or to motorized shades having an externally mounted motor.

Referring to FIGS. 2 and 3, a portion of the roller shade 10 of FIG. 1 is shown with the shade fabric 14 fully unwound with respect to the roller tube 12 to show the connection between the roller tube 12 and the shade fabric 14. The roller tube 12 defines a recessed channel 24 in the outer surface 22 thereof. The channel 24 includes opposite side walls 26, 28 extending longitudinally along the roller tube 12. As shown in FIG. 3, extensions 30 are provided on the opposite side walls 26, 28 of the channel 24 to aid in retaining inserts, described more fully below.

The shade engagement system for roller shade 10 includes an insert 32 received in the channel 24 of the roller tube 12. The insert 32 includes an elongated body 34 in the form of a plate defining opposite side edges 36, 38 extending longitudinally along the body 34. The insert 32 also includes prongs 40 each connected to the body 34 adjacent side edge 38 within a recess 42 defined in the side edge 38. Preferably, the insert 32 is made from a deformable metal and the prongs 40 and recess 42 are formed using a punching process. A suitable metal is aluminum, and a preferred aluminum is aluminum 6061-T4. The deformable insert 32 is not limited to metals or to formation of prongs using a punching process. It is within the scope of the invention, for example, to form the insert from a molded material. The material used to form insert 32, however, must have sufficient toughness such that the prong 40 can be deformed in the manner described below without fracturing and without significant loss of load carrying capability. The prongs 40 are shown in FIGS. 2 and 3 in a deformed state. Prior to being deformed, each of the prongs 40 is preferably located in its entirety within the periphery of body 34, as shown by the undeformed prong 40 illustrated in the insert shown in FIG. 4, for example.

Referring again to FIGS. 2 and 3, the insert 32 is engaged to the roller tube 12 to secure the shade fabric 14 to the roller tube 12 in the following manner. As shown in FIG. 3, an end portion 44 of the shade fabric 14 is placed in the channel 24 of the roller tube 12. The insert 32 is then placed into the channel 24 such that the shade fabric 14 is located between the insert 32 and side wall 26 of the channel 24. The insert 32 is preferably placed in the channel 24 with the prongs 40 in a substantially undeformed condition. This facilitates insertion of the insert 32 into the channel 24 in a transverse direction with respect to the channel 24 through the opening between the retainer extensions 30. Such transverse insertion of the insert 32, which may be described as a "front-loading" procedure, greatly simplifies assembly in contrast to an "end-loading" procedure in which the insert 32 is placed into the channel 24 from an end of the roller tube 12. Front loading the insert 32 into the channel 24 also enables assembly in limited clearance applications that would not allow for placement of the insert 32 into the channel 24 from an end of the roller tube 12.

Figure 4:
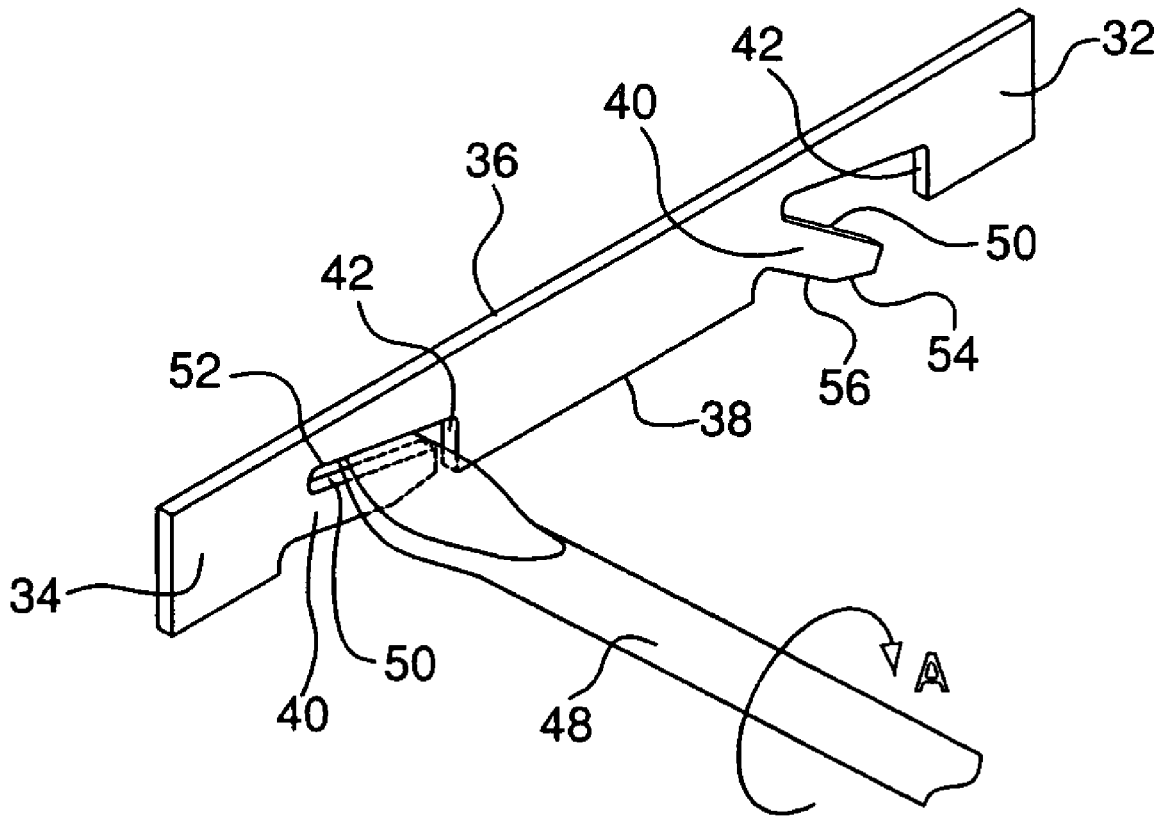
FIG. 4 is a perspective view illustrating deflection of the prongs of the insert member of the shade fabric securing system of FIG. 2.

With the end portion 44 of the shade fabric 14 and the insert 32 located in the channel 24 of the roller tube 12, the prongs 40 of the insert 32 are then deformed, in the manner shown in FIG. 4. The insert is illustrated in FIG. 4 without the roller tube 12 for clarity of the view to facilitate description. The prong 40 on the right-hand side of the insert 32, from the point of view of FIG. 4, has already been deformed. As shown by comparing the deformed prong 40 on the right of insert 32 with the undeformed prong 40 on the left of the insert 32, the deformation of a prong 40 pivots the prong 40 with respect to the body 34 such that a terminal end portion 46 of the prong 40 extends from the associated recess 42 beyond the side edge 38 of the body 34.

As shown in FIG. 4, the prongs 40 of the insert 32 are deformed by insertion of a flat-head screwdriver 48 into a slot defined between a side edge 50 of an undeformed prong 40 and an edge 52 of the recess 42. A force couple is created as the screwdriver 48 comes into contact with the edge 52 and the prong side edge 50 during rotation of the screwdriver 48 in the direction shown by arrow A in FIG. 4. Torque subsequently applied to the screwdriver 48 deforms the prong 40 to pivot the prong 40 with respect to body 34.

Referring again to FIGS. 2 and 3, the pivoting of the prongs 40 of insert 32 moves the terminal end portion 46 of the prong 40 out of the recess 42 of body 34 from a retracted position to an extended position, as shown in FIG. 4. The pivoting of the prong 40 results in contact between the prong 40 and the side wall 28 of the channel 24 of roller tube 12. Further pivoting of the prong 40 following contact with the channel 24 drives the body 34 of insert 32 away from the side wall 28 of channel 24 and toward the side wall 26. The driven movement of the body 34 toward the side wall 26 of channel 24 tightly wedges insert 32 in channel 24 and grips the shade fabric 14 between body side edge 36 of insert 32 and the side wall 26 of channel 24. As shown, each prong 40 includes a taper 54 formed along a side edge 56 of the prong 40 in the terminal end portion 46 of the prong 40. The taper 54 creates a surface substantially parallel to the side wall 28 to maximize contact area thereby distributing force over more than a point contact.

The compression forces provided by wedging the insert 32 into place in channel 24 provides secure engagement between the shade fabric 14 and the roller tube 12 without damage to the shade fabric 14 associated with other forms of attachment such as stapling or gluing, for example. The distribution of the compression along the entire side edge 36 of the insert body 34 provides for optimized engagement and a more uniform attachment of the shade fabric 14 to roller tube 12. The distribution of compression forces along the entire edge 36 of body 34 limits localized areas of point contact that could apply excessive pressure potentially damaging the fabric.

The construction of insert 32 makes it easy to adjust the relative position between the shade fabric 14 and the roller tube 12 during the installation process. When the end portion 44 of shade fabric 14 and the insert 32 have been placed in the channel 24, but prior to deformation of the prongs 40, the shade fabric position may readily be adjusted to ensure proper positioning of the shade fabric 14 when the prongs 40 are pivoted to secure the shade fabric 14 in the above-described manner. Alternatively, the prongs 40 could first be pivoted to provide only slight contact pressure along side edge 36 of body 34, and the shade fabric 14 finally positioned, prior to fully pivoting the prongs 40 to firmly secure the shade fabric 14 to the roller tube 12.

Provided that the material for the insert 32 has sufficient toughness, which is a measure of the material's ability to undergo strain without suffering brittle fracture, the prongs 40 could be pivoted outwardly from the associated recess 42 and returned thereto in multiple cycles, without fracture. The capability for multiple cycles of pivoting for the prongs 40 would provide for disengagement between an installed insert 32 and the associated roller tube 12 and reengagement therebetween, to adjust or replace a shade fabric 14 for example. The capability for multiple cycles of pivoting for the prongs 40 would also provide for removal of an insert 32 from one roller tube 12 for use with another roller tube 12.

Figure 5:
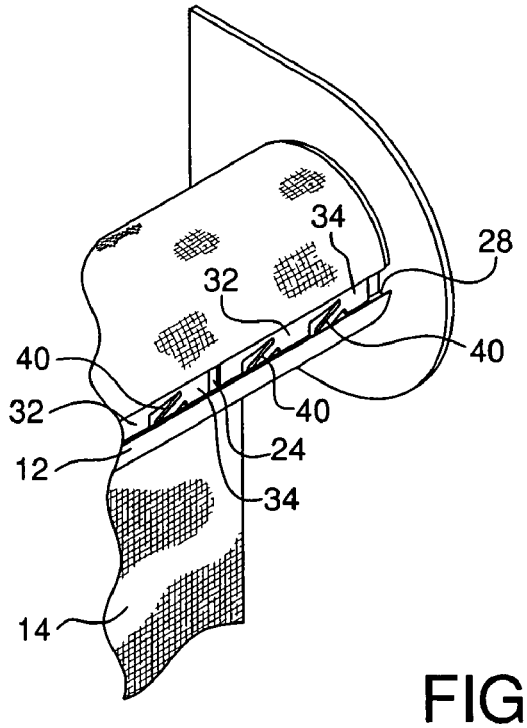
FIG. 5 is a partial perspective view of a roller shade illustrating a shade fabric securing system including insert members according to one embodiment of the invention.

Referring to FIG. 5, a roller tube 12 is shown with two inserts 32 installed in the channel 24 of a roller tube 12 adjacent an end 58 of the roller tube 12. As shown, the two inserts 32 have been installed in the channel 24 such that they are located adjacent to each other. Preferably, a series of adjacent inserts 32 are installed such that they extend substantially continuously along the entire length of the roller tube 12. However, a substantially continuous array of inserts 32 along the entire length of the roller tube 12 is not required. It is within the scope of the invention, for example, to install multiple inserts 32 in a roller tube channel 24 with substantial gaps between the inserts 32. A substantially continuous array of inserts 32, however, desirably provides for uniform compression forces on the shade fabric 14 along substantially the entire length of the roller tube 12.

Figure 6:
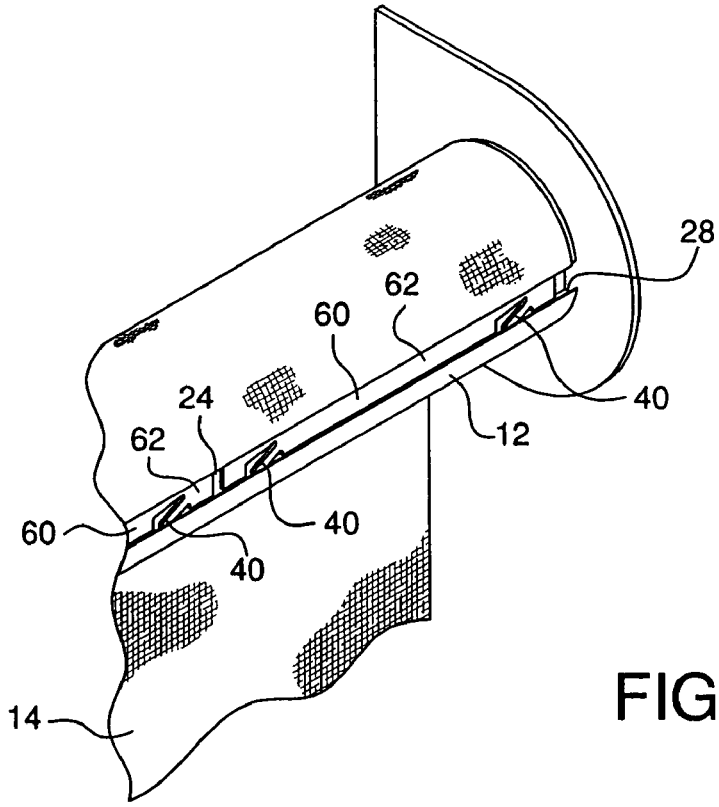
FIG. 6 is a partial perspective view of a roller shade illustrating a shade fabric securing system including insert members according to another embodiment of the invention.

Referring to FIG. 6, a shade fabric 14 is shown secured to a roller tube 12 by multiple, adjacently located, inserts 60 having an alternative construction to the inserts 32 of FIG. 5. As shown by comparing FIGS. 5 and 6, the insert 60 includes a body 62 that is longer than body 34 of insert 32. Insert 60 includes a pair of prongs 40 that are similar in construction to the prongs 40 of insert 32. Thus, because of the longer body 62, each insert 60 of FIG. 6 engages a wider portion of the shade fabric 14 than the insert 32 of FIG. 5 without requiring that additional prongs 40 be pivoted. For each of inserts 32, 60, the pair of prongs 40 are located adjacent opposite ends of the respective body 34, 62. This construction provides a stable configuration when the insert 60 is installed in the roller tube channel 24.

It is not required that each insert 60 have only a pair of prongs 40. Each insert 60 could include one or more additional prongs 40. It is also not a requirement of the invention that multiple inserts 32, 60 be used to secure a particular shade fabric 14 to a roller tube 12. A single insert having multiple prongs and a length approximating that of the roller tube 12, for example, could be used.

Figure 7:
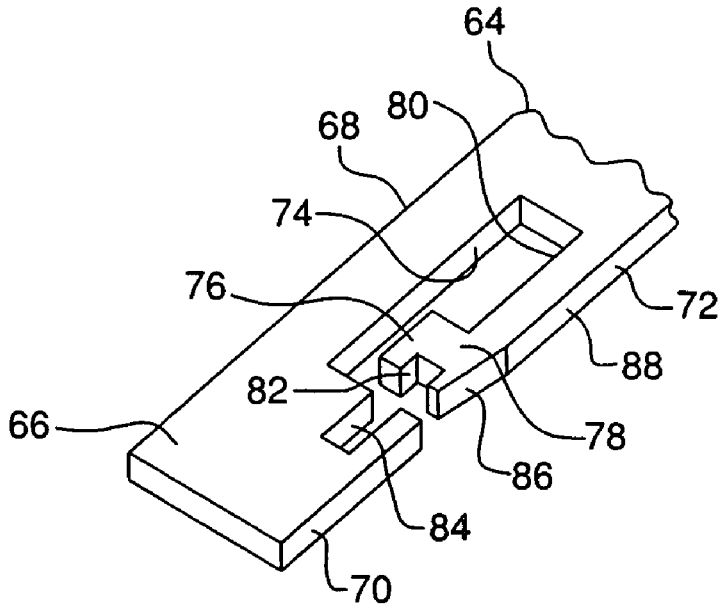
FIG. 7 is a partial perspective view illustrating an insert member having a deflectable prong according to another embodiment of the invention.

Referring to FIG. 7, there is illustrated an insert 64 according to the present invention. As shown in FIG. 7, insert 64 includes a body 66 having opposite side edges 68, 70 that extend longitudinally along the body 66. The insert 64 includes a deflectable prong 72 connected to the body 66 adjacent the side edge 70 and located within a recess 74 formed in body 66. The prong 72 of insert 64 includes a tool-receiving formation 76 at a terminal end portion 78 of the prong along a side edge 80 of the prong 72. The tool-receiving formation 76 includes a notch 82 that is substantially aligned with a notch 84 formed in the body 66 when the prong 72 is in the undeformed condition shown in FIG. 7.

Receipt of a tool, such as a flat-headed screwdriver, in the aligned notches 82, 84 provides for contact between the tool and the body 66 and prong 72. Torque applied to the tool deforms the prong 72 to pivot the prong 72 with respect to body 66 to an extended position. When extended, prong 72 secures shade fabric 14 within the channel 24 of a roller tube 12 in a similar manner as described above for inserts 32, 60. The prong 72 includes a taper 86 in the terminal end portion 78 of the prong located on a side edge 88 of prong 72 that is opposite the tool-receiving formation 76. As described above, the taper 86 creates a surface that is substantially parallel to an adjacent side wall of a roller tube channel in which the insert 64 is placed.

The prong 72 of insert 64 is connected to the body 66 such that the side edge 88 of the prong 72 is substantially aligned with the side edge 70 of the body 66 when the prong 72 is undeformed. This location of the prong 72 with respect to the body 66 of insert 64 differs from that of prong 40 of inserts 32, 60, which is indented slightly with respect to the body of the insert when undeformed, as shown by the insert 32 of FIG. 4. Location of the prong 72 of insert 64 at the outward edge of the recess 74 in this manner thus provides for wedging compression of the insert 64 to firmly secure a shade fabric 14 with less pivoting of the prong 72 being required compared to prong 40, which is indented within the periphery of the associated body in the retracted position.

Figure 8:
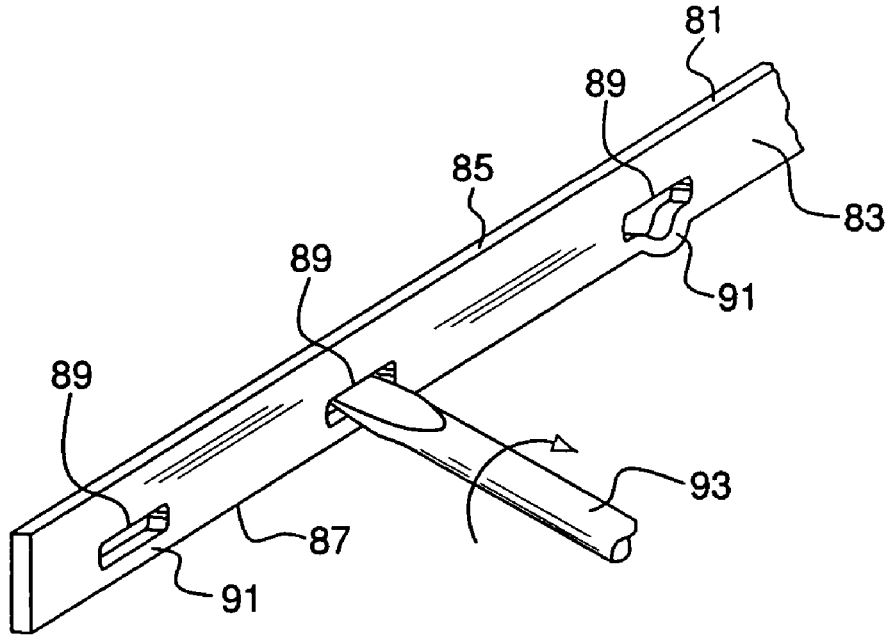
FIG. 8 is a partial perspective view illustrating an insert member having deformable slot walls according to another embodiment of the invention.
Figure 9:
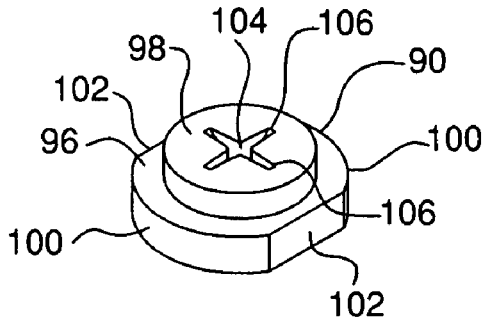
FIG. 9 is a perspective view of a rotatable insert for a shade fabric securing system according to another embodiment of the invention.

Each of the above-described inserts 32, 60, 64 includes an elongated prong 40, 72 that is pivotable with respect to the side edge of the associated body of the insert. Referring to FIG. 8, there is illustrated an insert 81 according to another embodiment of the invention. The insert 81 includes a body 83 defining opposite side edges 85, 87. The insert 81 also includes elongated slots 89 formed in the body 83. As shown, the slots 89 are located inwardly from side edge 87 sufficiently to form a relatively thin slot wall 91 in the body 83 adjacent each slot 89. In contrast to the above-described prongs 40, 72, each of which was unconnected to the associated body at a terminal end, the slot walls 91 of insert 81 are connected at both ends to the body 83. As shown, receipt of a flat-head screwdriver 93 in the slot 89, and rotation of the screwdriver with respect to the body 83, results in a deformation of the adjacent slot wall 91 such that an intermediate portion of the slot wall 91 is forced outwardly with respect to the side edge 87.

Referring to FIGS. 9–12, there is illustrated a fabric securing system according to an another embodiment of the invention including a rotatable insert 90. The rotatable insert 90 includes a body 96 and an upper tool-receiving head 98 connected to the body 96. The body 96 of insert 90 has an outer periphery including diametrically opposite curved portions 100 and orthogonally located diametrically opposite flat portions 102. As shown, the body 96 is preferably formed by flattening a circular disc-like member to form the flat portions 102 on opposite sides of the body.

The tool-receiving head 98 includes a tool-receiving formation 104 including intersecting slots 106. The formation 104 is located on the tool-receiving head 98 at a central axis of the insert 90 to facilitate pivoting of the insert 90 about a central axis, such as by a Phillips-head screwdriver 108, for example, as shown in FIG. 12 by arrow A.

Figure 10:
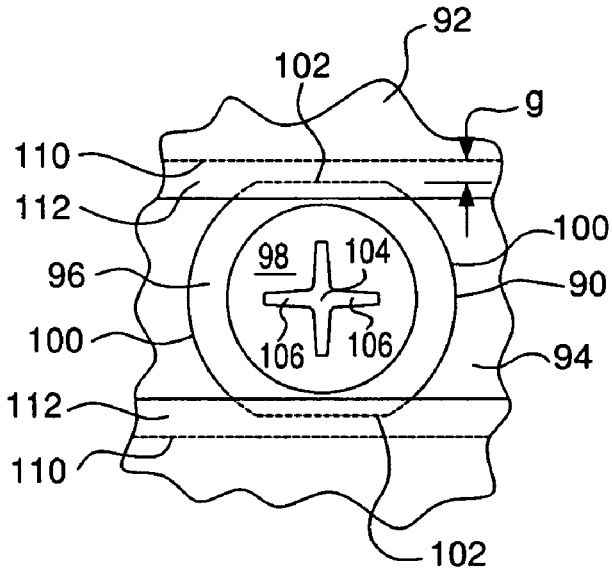
FIGS. 10 and 11 are top plan views of illustrating installation of the rotatable insert of FIG. 9 in a roller tube channel.

Referring to FIG. 10, the insert 90 is receivable within the channel 94 of the roller tube 92 between opposite side walls 110 and opposite extensions 112. The received insert 90 is retained within the channel 94 of roller tube 92 by the extensions 112. The insert body 96 is dimensioned to provide gaps, g, between the flat portions 102 of body 96 and the channel side walls 110 when the insert 90 is oriented as shown in FIG. 10.

Figure 11:
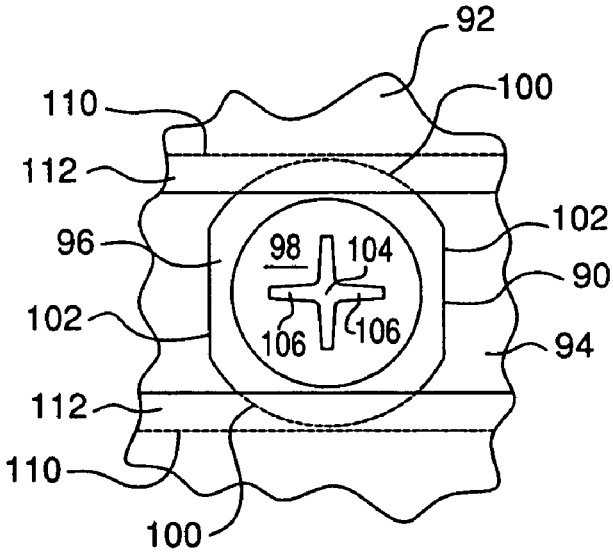

Referring to FIG. 11, the curved portions 100 of the body 96 are dimensioned to allow the insert 90 to pivot within the roller tube channel 94 about the central axis of the insert 90. As shown, pivoting the insert 90 from the orientation shown in FIG. 10 to the orientation shown in FIG. 11 results in substantial elimination of the gap between the outer periphery of the body 96 and the side walls 110 of the channel 94. The curved portions 100 of body 96 are preferably dimensioned to provide a close-clearance fit between the opposite side walls 110, without interference with the channel 94, when the insert 90 is in the orientation shown in FIG. 11.

Figure 12:
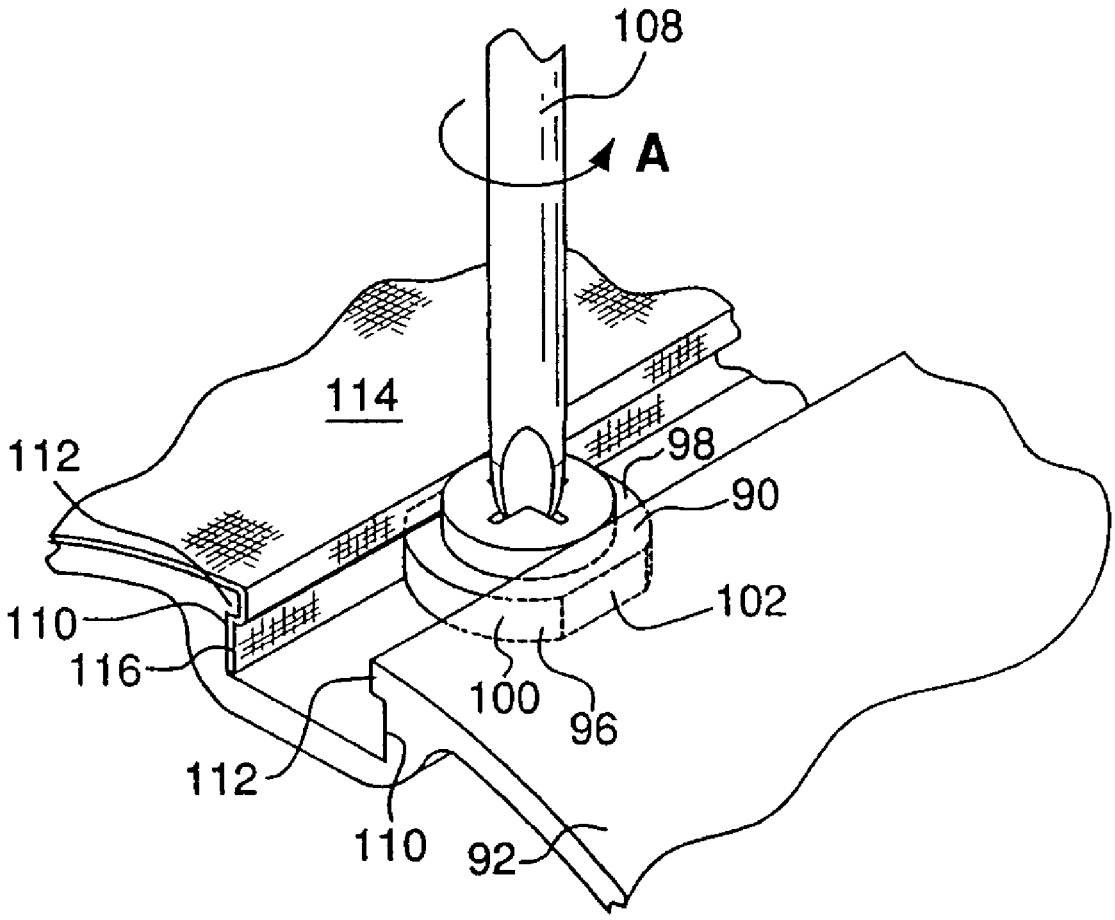
FIG. 12 is a partial perspective view illustrating installation of the rotatable insert of FIG. 9 in a roller tube channel.

Referring to FIG. 12, the rotatable insert 90 functions to secure a shade fabric 114 to the roller tube 92 in the following manner. An end portion 116 of the shade fabric 114 is placed in the channel 94 of the roller tube 92. The rotatable insert 90 is then inserted into the channel 94 such that the shade fabric 114 is located between the insert 90 and the roller tube 92. The insert 90 is preferably placed in the channel 94 in the relative orientation shown in FIG. 10. This orientation facilitates receipt of the insert 90 within the channel 94 and also provides for adjustment of the shade fabric 114 with respect to the roller tube channel 94 prior to engagement of the rotatable insert 90 to secure the shade fabric 114 to the roller tube 92.

The insert 90 is then pivoted to the orientation of FIG. 11, such as by applying torque using a screwdriver received in the formation 104. The resulting reduction in the gap between the outer periphery of the body 96 of insert 90 and the channel side walls 110 compresses the shade fabric 114 between the curved portion 100 of body 96 and the roller tube 92. The compression of the shade fabric 114 secures the shade fabric 114 to the roller tube 92. Preferably, a series of rotatable inserts 90 would be used to engage the shade fabric at spaced locations along the length of the roller tube 92. The number of rotatable inserts 90 used, and the spacing provided between adjacent inserts, could vary depending on the particular application.

The rotatable insert 90 illustrated in FIGS. 9–12 provides for engagement between the end portion 116 of shade fabric 114 and roller tube 92 to secure the shade fabric 114 to the roller tube 92 without damaging the shade fabric 114. The engagement between the shade fabric 114 and the roller tube 92 provided by the rotatable insert 90 is also readily releasable simply by pivoting the insert 90 from the orientation shown in FIG. 11 to the orientation shown in FIG. 10. This desirably facilitates adjustment of the relative positioning of a shade fabric with respect to a roller tube without requiring removal of the shade fabric or the inserts. The rotatable insert also provides for alternative removal of a shade fabric and inserts from one roller tube, for use with another roller tube for example.

The foregoing describes the invention in terms of embodiments foreseen by the inventors for which an enabling description was available, notwithstanding that insubstantial modifications of the invention, not presently foreseen, may nonetheless represent equivalents thereto.

What is claimed is:

1. A system for securing a flexible shade fabric to a rotatably supported roller tube for winding receipt of the flexible shade fabric onto the tube comprising:

at least one insert member defining an elongated body having opposite first and second side edges extending longitudinally along the body, and at least one elongated prong connected to the body in a recess defined in the first side edge of the body, the prong being pivotable from a first position in which the prong is located within the recess to a second position in which a terminal end portion of the prong extends from the recess to beyond the first side edge of the body; and a channel including opposite first and second side walls defined by the roller, the channel dimensioned for receipt of an end portion of the flexible shade fabric, the insert member receivable within the channel to engage the end portion of the shade fabric between the roller tube and the insert member, wherein pivoting of the at least one prong to the second position results in contact between the terminal end portion of the prong and the first side wall of the channel and drives the body toward the second side wall of the channel to compress an end portion of a shade fabric between the body and the channel.

2. A system for securing a flexible shade fabric to a rotatably supported roller tube for winding receipt of the flexible shade fabric onto the tube comprising:

an insert member including a body having opposite first and second side edges and at least one elongated slot formed in the body, the at least one slot located inwardly from the first side edge of the body to define a slot wall adjacent the first side edge having opposite ends connected to the body; and a channel including opposite first and second side walls defined by the roller, the channel dimensioned for receipt of an end portion of the flexible shade fabric, the insert member receivable within the channel to engage the end portion of the shade fabric between the roller tube and the insert member, the insert member being dimensioned such that no part of the insert member extends beyond a maximum diameter of the roller tube, the second side edge of the body and the second side wall of the channel cooperating to engage the end portion of the shade fabric therebetween, the slot wall defined by each of the at least one slots being outwardly deflectable with respect to the first side edge such that contact between the slot wall and the first side wall of the channel urges the body of the insert member toward the second side wall of the channel to compressively secure the end portion of the shade fabric to the roller tube between the second side edge of the body and the second side wall of the channel.

3. The shade fabric securing system according to claim 1, comprising a plurality of insert members.

4. The shade fabric securing system according to claim 1, wherein the body of the insert member includes opposite ends and wherein the insert member includes at least two prongs each located adjacent one of the ends of the body.

5. The shade fabric securing system according to claim 1, wherein the body and the at least one prong of the insert member are made from aluminum.

6. The shade fabric securing system according to claim 1, wherein the recess defines a tool-receiving slot adapted for receipt of a tool to apply a pivoting force to the prong.

7. The shade fabric securing system according to claim 6, wherein the slot is defined by a notch at a terminal end of the prong and an oppositely aligned notch in the body of the insert member.

8. The shade fabric securing system according to claim 1, wherein each prong includes a terminal end portion and wherein the terminal end portion of the prong defines a taper along a side edge of the prong, the taper defining a surface substantially parallel to the first side wall of the channel when the prong is pivoted.

9. The shade fabric securing system according to claim 1, including first and second retainer extensions on respective first and second side walls of the channel.

10. A system for securing a flexible shade fabric to a rotatably supported roller tube for winding receipt of the flexible shade fabric onto the tube comprising:

an insert member including a body having diametrically opposite portions defining a curved outer periphery and orthogonally located diametrically opposite portions defining a substantially planar outer periphery, the body being wider between the curved outer periphery than between the substantially planar outer periphery; and a channel including opposite first and second side walls defined by the roller, the channel dimensioned for receipt of an end portion of the flexible shade fabric, the insert member receivable within the channel to engage the end portion of the shade fabric between the roller tube and the insert member, the insert member being pivotable about an axis to compress the end portion of the shade fabric between the second side wall of the channel and one of the curved portions to secure the shade fabric to the roller tube;

the insert member further comprising a tool-receiving head located on the body including at least one recessed slot for receipt of a tool to facilitate pivoting of the member about the axis, the tool-receiving head comprising a disc defining a substantially circular outer periphery.

11. The shade fabric securing system according to claim 10, wherein the tool-receiving portion includes intersecting slotted recesses.

12. The shade fabric securing system according to claim 10, wherein the curved portions of the insert member lie substantially along a circle.

13. The shade fabric securing system according to claim 12, wherein the body is a substantially circular disc having flat portions on opposite sides thereof defining the planar portions.

14. A deformable member for securing a flexible shade fabric of a shade roller to a roller tube, the roller tube including a channel having opposite first and second side walls extending longitudinally along the roller tube for receiving an end portion of a shade fabric, the deformable member comprising:

an elongated body having opposite first and second side edges extending longitudinally along the body; and at least one elongated prong connected to the body in a recess defined in the first side edge of the body, the prong being pivotable from a first position in which the prong is located within the recess to a second position in which a terminal end portion of the prong extends from the recess to beyond the first side edge of the body, the body being receivable within the channel of the roller tube with the at least one prong in the first position, pivoting of the at least one prong to the second position resulting in contact between the terminal end portion of the prong and the first side wall of the channel and driving the body toward the second side wall of the channel to compress an end portion of a shade fabric between the body and the channel.

15. The deformable member according to claim 14, wherein the body and the at least one prong are made from aluminum.

16. The deformable member according to claim 14, wherein the body includes opposite first and second ends and first and second prongs respectively located adjacent the first and second ends of the body.

17. The deformable member according to claim 14, wherein the at least one prong includes a taper formed along a side edge of the prong in the terminal end portion of the prong.

18. A member for securing a flexible shade fabric to a roller tube, the roller tube including a channel having opposite side walls extending longitudinally along the roller tube for receiving an end portion of a shade fabric, the shade securing member comprising:

a body having diametrically opposite curved portions defining a substantially circular outer periphery and orthogonally located diametrically opposite portions defining a substantially planar outer periphery, the body being wider between the substantially circular periphery than between the substantially planar periphery, the member being pivotable about an axis to grip an end portion of a shade fabric between one of the side walls of the channel and one of the substantially circular portions of the body; and a tool-receiving head located on the body including at least one recessed slot for receipt of a tool to facilitate pivoting of the member about the axis, the tool-receiving head comprising a disc defining a substantially circular outer periphery.

19. The shade securing member according to claim 18, wherein the at least one recessed slot in the tool-receiving head includes a pair of intersecting slots.

20. The shade securing member according to claim 18, wherein the body and tool-receiving head are adapted for receipt within a channel having retainer extensions on each of the opposite side walls of the channel such that an outer peripheral portion of the body is located between the channel and each of the retainer extensions.

* * * * *